US005249718A

United States Patent [19]

Muderlak

[11] Patent Number: 5,249,718

[45] Date of Patent: Oct. 5, 1993

[54] AUTOMATIC PUMP-TYPE SPRAY DISPENSER

[75] Inventor: Kenneth J. Muderlak, Shorewood, Wis.

[73] Assignee: Technical Concepts, Elk Grove Village, Ill.

[21] Appl. No.: 852,080

[22] Filed: Mar. 16, 1992

[51] Int. Cl.[5] ..... G04C 23/00

[52] U.S. Cl. ..... 222/642; 222/333; 222/1; 239/70

[58] Field of Search ..... 222/642-649, 222/504, 505, 333, 321, 1; 239/70

[56] References Cited

U.S. PATENT DOCUMENTS

| | | | |
|---|---|---|---|
| Re. 29,117 | 1/1977 | Sahajian et al. | 222/649 |
| 3,018,056 | 1/1962 | Montgomery | 222/647 X |
| 3,139,218 | 6/1964 | Cairelli | 222/647 |
| 3,165,238 | 1/1965 | Wiley | 222/645 |
| 3,214,062 | 10/1965 | Mahon | 222/649 |
| 3,216,618 | 11/1965 | Hunter | 222/647 |
| 3,318,159 | 5/1967 | Cielaszyk | 222/647 X |
| 3,388,834 | 6/1968 | Hart | 222/649 |
| 3,411,670 | 11/1968 | Mangel | 222/649 |
| 3,462,082 | 8/1969 | Everett | 239/332 |
| 3,584,766 | 6/1971 | Hart | 222/648 |
| 3,587,332 | 6/1971 | Bell | 222/645 |
| 3,589,563 | 6/1971 | Carragan et al. | 222/648 |
| 3,709,636 | 1/1973 | Rosenberg | 417/12 |
| 3,732,509 | 5/1973 | Florant et al. | 222/645 X |
| 3,739,944 | 6/1973 | Rogerson | 222/649 |
| 3,952,916 | 4/1976 | Phillips | 222/645 |
| 4,006,844 | 2/1977 | Corris | 222/649 |
| 4,063,664 | 12/1977 | Meetze | 222/648 |
| 4,235,373 | 11/1980 | Clark | 239/70 X |
| 4,238,055 | 12/1980 | Staar | 222/162 |
| 4,483,466 | 11/1984 | Guitierrez | 232/647 |
| 4,817,822 | 4/1989 | Rand et al. | 222/38 |
| 4,830,791 | 5/1989 | Muderlak | 239/35 X |
| 4,967,935 | 11/1990 | Celest | 222/642 X |
| 5,038,972 | 8/1991 | Muderlak | 222/649 X |

FOREIGN PATENT DOCUMENTS

| | | | |
|---|---|---|---|
| 738270 | 7/1966 | Canada | 222/645 |

*Primary Examiner*—Kevin P. Shaver
*Attorney, Agent, or Firm*—Welsh & Katz, Ltd.

[57] ABSTRACT

A fluid dispenser having an actuating mechanism for operating a pump-type spray container is provided for quiet operation and improved reliability. The actuating mechanism includes a cam/lever arm assembly having a lever tip which slides down the sloping surface of the cam such that it controls the downward impact force of the lever arm on the spray head.

20 Claims, 7 Drawing Sheets

.250
2.20
.90
50
94
44
40
42
52
48
46
2.00
3.125

AUTOMATIC PUMP-TYPE SPRAY DISPENSER

CROSS REFERENCE TO RELATED PATENTS

This application contains subject matter related to U.S. Pat. Nos. 4,830,791 and 5,038,972, both of which are assigned to the same assignee as the present application, and both of which are hereby incorporated by reference.

BACKGROUND OF THE INVENTION

The present invention generally relates to automatic fluid dispensing devices, and, more particularly, to pump-type spray dispensers of the kind generally utilized for dispersing fragrances or insecticides into the atmosphere.

Numerous types of automatic devices are utilized in public facilities for dissipation of malodoriferous aromas. For example, one type of odor control device utilizes a powered fan to assist in the movement of air over a tub or container which is filled with odor-covering material, such as an odoriferous gel. Such an odor control device is described in U.S. Pat. No. 4,830,971. Moreover, pressurized aerosol containers have been used with automatic dispensers to spray fragrances and/or insecticides into the atmosphere at periodic time intervals. One such metered aerosol fragrance dispenser is described in U.S. Pat. No. 5,038,972, wherein a segmented gear and cam arrangement are used for activating the spring-loaded spray button of the aerosol container.

A different type of pressurized aerosol can dispenser actuating mechanism is shown in U.S. Pat. No. 3,589,563 issued to Carragan et al. In that patent, a spring-biased actuating lever arm is pivotally mounted for rocking movement about a stub shaft, having a cam follower at the free end. The cam follower rides upon the surface of a snail-shaped cam which is integrally formed with a motor-driven gear arrangement. Rotation of the gear arrangement causes the cam follower to reach a point of drop-off on the cam, wherein the actuating arm swings downwardly under the force of the biasing spring to exert sufficient force on the cap of the aerosol container to overpower the container spring valve and initiate discharge. Continued rotation of the cam gear causes the cam follower to ride up along the snail-shaped portion of the cam and release the aerosol container cap, which completes the discharge cycle. A similar cam/lever arm actuating mechanism is used with a non-aerosol plunger or pump-type spray container in U.S. Pat. No. 4,235,373 issued to Clark.

However, several problems have occurred when the cam/lever-type actuating mechanism is used with a pump-type spray container. Non-pressurized pump-type fluid spray containers are normally designed for manual operation using a person's finger. Therefore, with an automatic pump-type spray dispenser, a strong biasing spring is required to quickly force the actuating lever arm downwardly for proper operation of the spray pump. For example, if the spray head of the container was slowly depressed into the container, little or no spray dispersion would occur.

Hence, each time the lever arm drops off the high point of the cam and impacts the container spray head, a loud noise is produced. If the spray dispenser is used in a room which people occupy continuously, then this "slapping" noise, occurring approximately every 15 minutes, becomes very annoying. Moreover, if the fluid dispenser is used in a room infrequently occupied by people, such as a public washroom, then the loud slap noise, which occurs suddenly in an otherwise quiet room, is quite startling. In either case, the loud slap noise produced when the lever arm contacts the spray head is a very undesirable characteristic of the pump-type spray dispensers known in the art.

Furthermore, a significantly high impact force is produced when the lever arm contacts the spray head and fluid pump mechanism of the container. This high impact force has been shown to reduce the operating life of the fluid dispenser pump and/or the spray head. Similarly, the high impact force has produced an undesirable amount of wear and tear on the cam/lever arm actuating mechanism assembly itself, as well as vibration of the electronic components which operate the actuating mechanism. In any event, the reliability of the spray dispensing devices of the prior art is affected.

A need, therefore, exists to find a practical, low-cost solution to reduce the high impact force of the lever arm on the fluid container of a pump-type spray dispenser and, accordingly, the noise produced thereby.

OBJECTS AND SUMMARY OF THE INVENTION

A primary object of the present invention is to provide an automatic pump-type spray dispenser which addresses the aforementioned problems in the prior art.

Another object of the present invention is to provide an improved cam/lever arm assembly which generates a controlled force upon a fluid dispenser having a pump-type spray mechanism.

A further object of the present invention is to provide a pump-type fluid spray actuating mechanism having quiet operation and improved reliability.

These and other objects are achieved by the present invention which, briefly described, is a fluid spray dispenser device comprising: a container for containing a fluid to be dispensed, the container including a pump having a depressible head associated with the pump for dispensing the fluid from the container when the head is depressed with sufficient force; a housing for supporting the container; a cam, rotatably affixed to the housing, for rotating around a central axis, the cam including an outer surface having a first surface portion constructed such that the radius of the cam outer surface generally increases as the cam is rotated about the central axis in a first direction, the cam outer surface further having a second surface portion constructed such that the radius of the cam outer surface generally decreases as the cam is rotated about the central axis in the first direction; a mechanism for rotating the cam; an actuator lever for depressing the depressible head upon contact with the depressible head, the lever having a first portion disposed adjacent the cam, and a second portion movably connected to the housing such that the first portion is adapted to contact and slide upon the cam outer surface; and a spring for providing a force on the lever such that the first portion of the lever is biased to maintain contact with the cam outer surface during at least a portion of the rotation of the cam, and such that the lever is adapted to provide a spring force to the depressible head, wherein the cam controls the spring force on the depressible head during the portion of rotation of the cam when the lever contacts the second surface portion of the cam outer surface such that the lever depresses the depressible head with a controlled amount of force.

In accordance with the preferred embodiment of the invention, a fluid spray dispenser is provided which comprises: a container for containing a fluid to be sprayed, the container including a spray pump having a depressible spray head disposed outside the container, and having an orifice for spraying the fluid when the spray head is depressed with sufficient force; a housing for supporting the container; a cam rotatably affixed to the housing and rotatable around a central axis, the cam having an outer surface having a first portion formed generally in the shape of a spiral having an inner endpoint and an outer endpoint such that the radius of the cam outer surface increases as the cam is rotated about the central axis in a first direction, the cam outer surface further having a second portion formed as a generally flat surface and connecting the spiral inner and outer endpoints; a mechanism for periodically rotating the cam in the first direction at a constant rate of rotation; a lever arm having first and second end portions and a major longitudinal axis located between the first and second end portions, the first end portion having an outermost lever tip, the second end portion pivotally affixed to the housing such that the lever tip is adapted to contact the cam outer surface, and such that a portion of the lever arm is adapted to engage with and depress the spray head; and a spring for providing a force on the lever arm such that the lever tip is biased toward the spray head, the lever arm, cam, and spring constructed and arranged such that the lever tip contacts and follows the first portion of the cam outer surface during a first part of the cam rotation to move the lever arm away from the container, and such that the lever tip contacts and follows the second portion of the cam outer surface during a second part of the cam rotation to allow the lever arm to move toward the container and depress the spray head with a controlled force, wherein the lever tip slides along at least a portion of the generally flat surface in a controlled manner so as to reduce the impact of the lever arm on the spray head.

Another aspect of the present invention provides an actuation mechanism for a pump-type spray container having a spray head constructed and arranged to spray a fluid from the container when the spray head is depressed toward the container, the actuation mechanism comprising: a base; an electric motor mounted to the base; an electric power source; electronic circuitry for applying and controlling the electric power from the electric power source to the electric motor; a cam assembly having a cam and plurality of drive gears engaging the motor and the cam for providing an internal force for rotating the cam in a first direction, the motor and cam assembly constructed and arranged to provide a counteracting force to any external force providing additional rotation to the cam in the first direction; a lever arm having a major longitudinal axis and a first portion pivotally mounted to the base, and a movable end having a tip portion constructed and arranged to cooperate with the cam to move the lever arm as the cam rotates, and an actuator portion constructed and arranged to depress the spray head of the pump-type spray container; and a spring coupled between the lever arm and the base for providing a spring force to the lever arm for depressing the spray head; the lever arm constructed and arranged to cooperate with the cam such that the lever arm moves with the rotation of the cam by forcing the lever tip portion away from the spray head during a first phase of cam rotation, and by substantially but not entirely releasing the lever tip portion during a second phase of cam rotation such that the spring force causes the lever arm to quickly depress the spray head; the cam constructed and arranged to prevent the lever tip from being entirely released from the cam during the second phase of cam rotation such that the spring force on the lever arm provides the external force on the cam, and such that the motor and cam assembly provide the counteracting force to provide a slight damping action to the lever arm movement during at least a portion of the second phase of cam rotation.

In accordance with a further aspect of the present invention, a method of operation of a pump-type fluid dispenser is provided wherein the noise and impact of the actuating mechanism is controlled. The pump-type fluid dispenser includes a cam and lever assembly constructed and arranged to provide an inward force on a container spray head for a first period of time, and to release the inward force on the container spray head for a second period of time by forcing the lever away from the spray head by cooperating with the cam, the cam having an outer surface with a connection point between an inner diameter surface and an outer diameter surface. Accordingly, the method of operation comprises the steps of: (a) turning the cam in a first direction and forcing the lever away from the spray head using the cam; (b) further turning the cam in the first direction until the lever passes the connection point of the cam outer surface; and (c) controlling the impact of the lever on the container spray head by utilizing the reverse torque of the cam after the lever arm passes over the connection point.

BRIEF DESCRIPTION OF THE DRAWINGS

The features of the present invention which are believed to be novel are set forth with particularity in the appended claims. The invention itself, however, together with further objects and advantages thereof, may best be understood by reference to the following description when taken in conjunction with the accompanying drawings, in which:

DETAILED DESCRIPTION OF THE INVENTION

Figure 1:
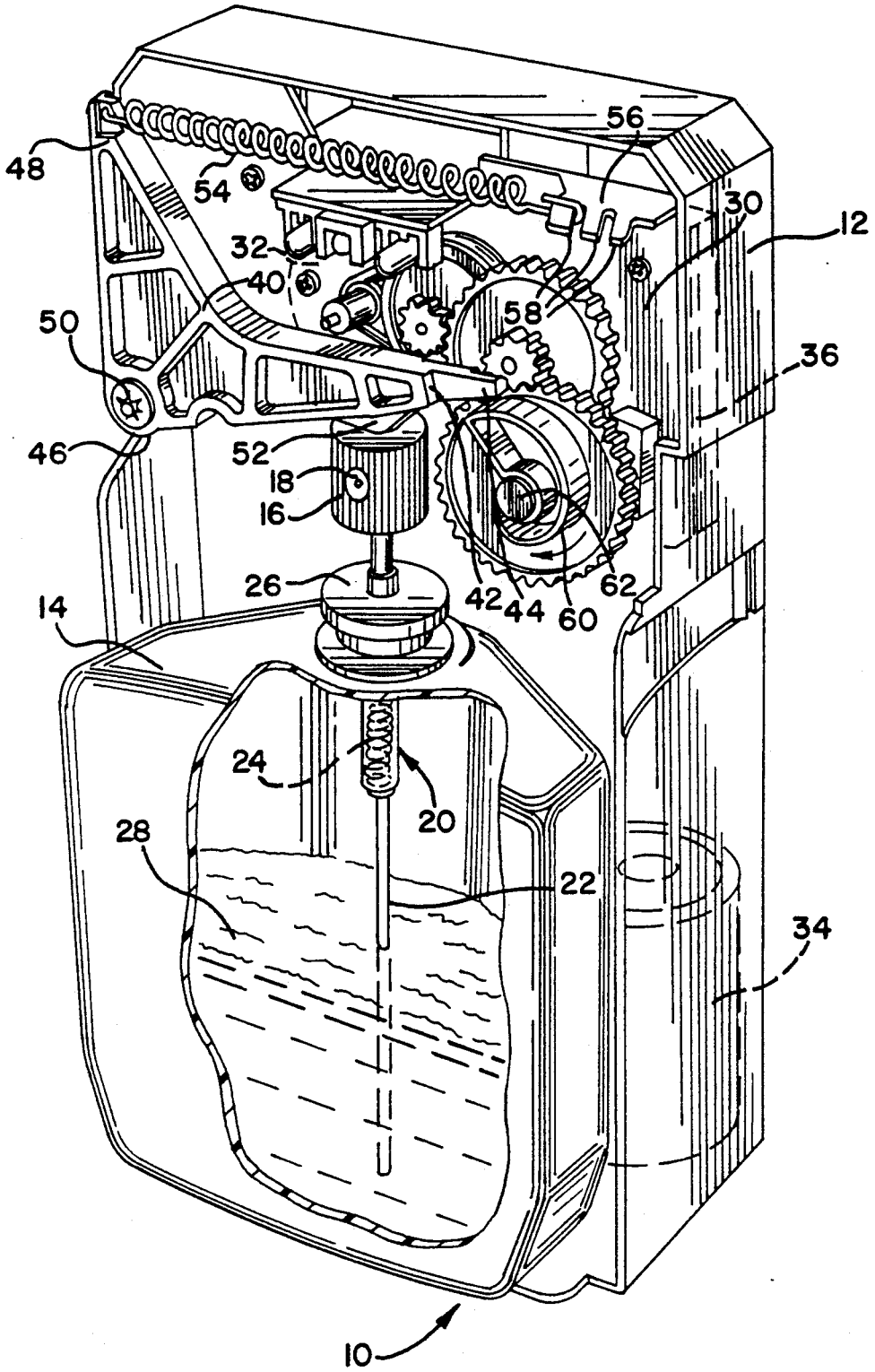
FIG. 1 is a perspective view of the automatic pump-type spray dispenser of the present invention, shown with the front cover removed to illustrate the spray pump actuating mechanism and fluid container.

Referring now to FIG. 1, an automatic pump-type fluid spray dispenser 10 is shown in perspective view. The dispenser is comprised of a housing 12 which supports and encloses a container 14 for fluid. The housing 12 is shown with the front cover removed to more clearly illustrate the spray pump actuating mechanism and fluid container 14. The container 14 includes a spray head 16 having an orifice 18 for spraying the fluid from the container when the spray head 16 is depressed downwardly toward the container 14. The spray head 16, in the preferred embodiment, includes a slight concave depression in its top surface, for purposes to be described later.

A plunger-type spray pump 20 is disposed at least partially within the container 14. In the preferred embodiment, the spray pump 20 is a hydraulic-type fluid pump partially located within the container 14 and which is normally adapted for manual operation using a person's finger As known in the art, the spray pump 20 utilizes a hydraulic action to force fluid into an intake tube 22 and out the orifice 18 in the spray head 16. A pump spring 24 serves to return the spray head 16 to its non-depressed position shown in FIG. 1. A container cap 26 keeps the spray pump 20 attached to the container 14. The container cap 26 may be permanently attached to the container 14 as shown, or may be a screw-on type which can be removed by the user of the device such that the container 14 can be refilled. In the preferred embodiment of a fragrance dispenser, the fluid 28 within the container is a fragrance liquid.

As shown in FIG. 1, the spray pump actuating mechanism is affixed to a baseplate 30 mounted to the housing 12 using a number of screws as shown. An electric motor 32, preferably a 3-volt DC motor, is affixed to the reverse side of the baseplate 30. A power source, comprised of batteries 34 or an AC adapter (not shown), is electrically connected to the motor 32. Timing circuitry 36, located behind the baseplate 30, is used for periodic activation of the motor 32. The timing circuitry used in the preferred embodiment is similar to that described in U.S. Pat. No. 5,038,972, which is incorporated herein by reference.

Figure 2B:
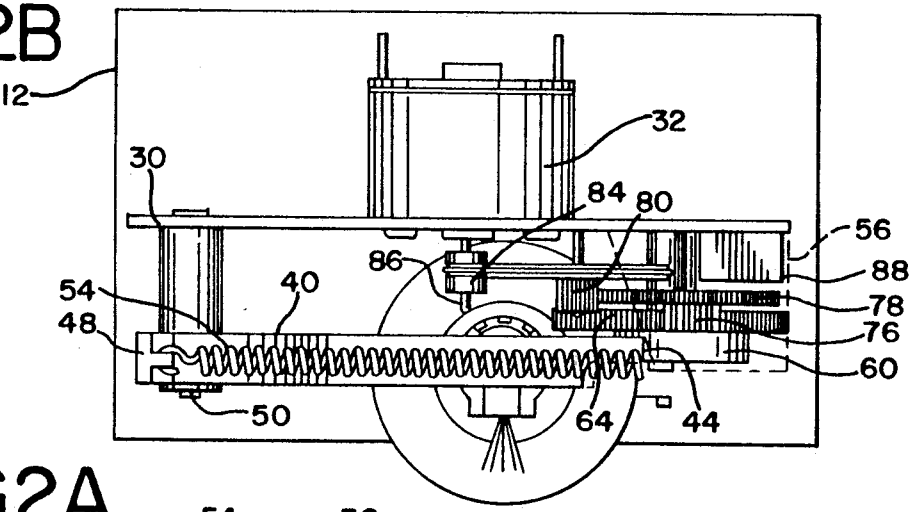
FIGS. 2A–2C provide a partial front, top, and right side view, respectively, of the spray dispenser of FIG. 1, showing the spray pump actuating mechanism in detail.
Figure 2A:
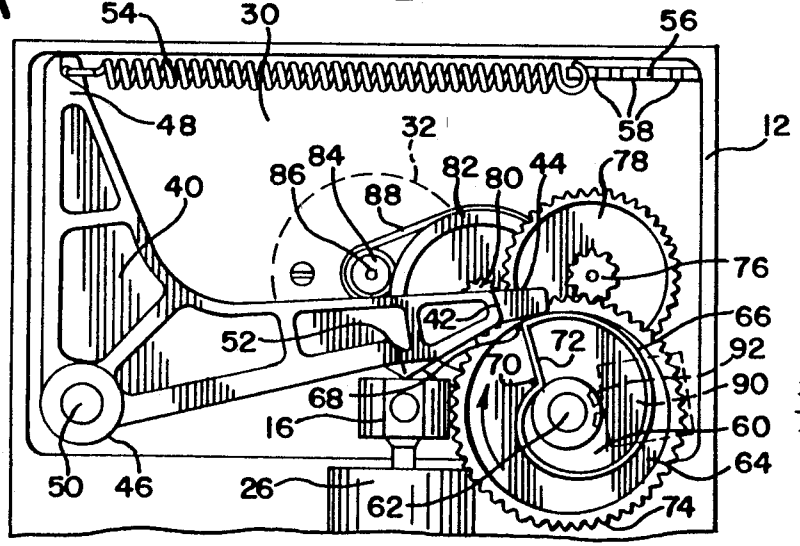
Figure 2C:
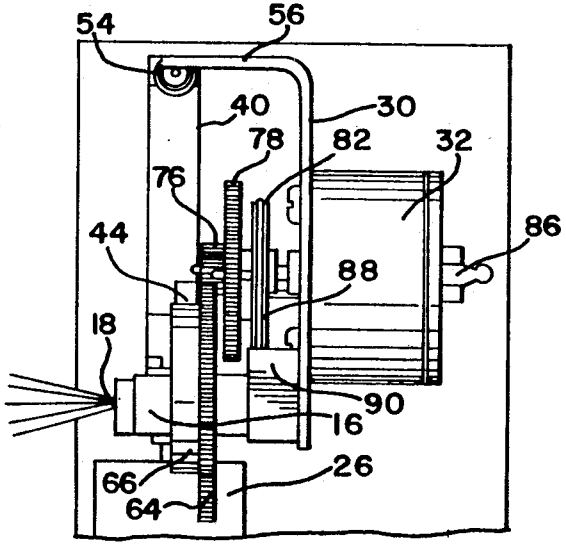

FIGS. 2A, 2B, and 2C, which provide front, top, and side views, respectively, of the actuating mechanism shown in FIG. 1, will now be described. A lever arm 40 has a first end portion 42 and a second end portion 46 as shown. In the preferred embodiment, the lever arm 40 is L-shaped, such that a third end portion 48 extends upwardly as shown. The baseplate 30 has a shaft perpendicularly affixed thereto which fits through a hole in the second end portion 46 and pivotally mounts the lever arm 40 at a pivot point 50 such that the first end portion 42 is movable. The first end portion 42 of the lever arm has a tip portion 44 at its outermost point. Between this lever tip 44 and the pivot point 50 lies the major longitudinal axis of the lever arm 40.

The lever arm 40 is constructed, in the preferred embodiment, to include an actuator finger 52 which is designed to fit within the depression on the top of the spray head 16 as shown. The use of the finger 52, in conjunction with the slight concave depression in the top surface of the spray head 16, serves to align the lever arm to the top of the container and prevents the finger 52 from sliding off the spray head 16 when in use.

A biasing spring 54 is attached at one end to the third end portion 48 of the lever arm 40, and is attached at the other end to a bracket 56 as shown. In the preferred embodiment, the bracket 56 is formed as an integral part of the baseplate 30, and bent at a 90° angle thereto. The bracket 56 includes a number of notches 58, three in this embodiment, which allow the tension of the spring 54 to be adjusted. As will be seen below, proper spring tension is an important factor in the operation of the present invention.

As illustrated in FIG. 2A, a cam 60 is constructed and arranged such that the outermost tip 44 of the first end portion 42 of the lever arm 40 contacts and follows the outer surface of the cam as the cam rotates on its central axis 62 in a clockwise direction as shown. In the preferred embodiment, the cam 60 is constructed of a very durable plastic, such as nylon, and is formed as an integral part of a cam gear 64 which is driven by the motor 32 and an arrangement of drive gears. The cam itself has an outer surface which has a first portion 66 formed generally in the shape of a spiral having an inner endpoint or inner corner 70, and an outer endpoint or drop-off edge 68 as shown. In other words, the snail-shaped cam 60 is formed such that the radius of the outer surface 66 increases as the cam is rotated about the central axis 62 in a clockwise direction during a first phase of rotation, such that the tip 44 of the lever arm 40, which rides upon this outer surface 66, is forced away from the cam central axis 62 as the cam is rotated clockwise.

The cam outer surface further includes a second portion or sloping surface 72 which serves to connect the spiral inner corner 70 and spiral drop-off edge 68 as shown. In the preferred embodiment, the sloping surface 72 is formed as a generally flat surface between the spiral endpoints, although the present invention should not be limited to this particular configuration. All that is required is that the cam 60 is formed such that the radius of the second portion of the outer surface decreases as the cam is rotated about the central axis 62 in a clockwise direction, such that the tip 44 of the lever arm 40, which rides upon this sloping surface 72, contacts and follows the cam outer surface during a second phase of cam rotation to allow the lever arm 40 to move toward the container 14 and depress the spray head 16 in a controlled manner. The detailed construction of the cam 60, including the dimensions of the sloping surface 72, will be shown below in detail.

Hence, in operation, the rotation of the cam 60 in a clockwise direction causes the tip portion 44 of the lever arm 40 to contact and slide down the sloping surface 72 in a controlled manner for a period of time after the tip of the lever arm it passes the drop-off edge 68. Once the lever arm 40 begins to swing downwardly toward the container 14 under the force of the spring 54, the finger 52 of the lever arm 40 engages the spray head 16 to initiate discharge of the fluid. Note that the angle of the sloping surface 72 prevents the lever tip 44 from disengaging from the cam outer surface as the lever tip 44 passes over the drop-off edge 68. In other words, during at least the initial portion of the downward stroke of the lever tip 42, the lever arm 40 is not allowed to free-fall over the drop-off edge 68. Instead, the lever tip 44 remains in contact with the cam outer surface over at least a portion of the generally flat sloping surface 72 so as to control the fall and reduce the impact force of the lever arm 40 on the spray head 16. Accordingly, the amount of downward impact force on the container spray head, and the noise associated there-with, can be controlled and significantly reduced from the case where the lever arm would be allowed to free-fall. The continued rotation of the cam 60 in a clockwise direction causes the lever tip 44 to ride up along the spiral surface 66 of the cam, forcing the lever tip 44 away from the cam central axis 62 until the cam stops at the reference position shown in FIG. 2A.

The cam gear 64 includes a number of teeth 74 around its periphery as shown. These teeth 74 engage with the teeth of a first pinion gear 76, which is affixed to a first drive gear 78 as shown. The first drive gear 78 is driven by the teeth of a second pinion gear 80, which is formed as an integral part of a main drive pulley 82. A motor drive pulley 84, securely affixed to the motor shaft 86, cooperates with a drive belt 88 to turn the main drive pulley 82, thus completing the drive path for the gear assembly. In the preferred embodiment, the drive gear assembly is geared such that one revolution of the cam 60 is completed in approximately 2 to 4 seconds, depending upon the battery voltage level applied to the motor 32. In any case, the cam/lever arm assembly of the present invention is preferrably designed to operate with a cam speed of rotation of less than one revolution-per-second.

A cycle switch 90 is affixed to the baseplate 30 and cooperates with a recess 92 in the cam shaft in order to ensure that the cam completes 360° of cam rotation and to locate the initial or resting position of the cam. Hence, when the timing circuitry activates the motor, the drive gears rotate the cam gear 64 which, in turn, forces the cycle switch 90 out of the cam shaft recess 92, wherein the switch closes to maintain power to the motor until the cam shaft recess 92 is again reached. The cycle switch 90 is adjusted to open approximately 20° before the lever tip 44 reaches the drop-off edge 68, such that the motor and cam inertia and/or part tolerances do not force the cam to begin another cycle after one cycle has been completed. On one hand, if the cam stops to late in its rotation, the dispenser device will continuously recycle. On the other hand, if the cam stops too soon in its rotation, the width of the electronic pulse provided by the timing circuitry may not force the lever tip off the drop-off edge of the cam, such that the cycle switch may never close. A complete circuit diagram for a similar type of cycle switch is shown in U.S. Pat. No. 3,589,563.

Referring now to FIGS. 3A-3D, graphic representations of alternative structural configurations of the cam/lever arm assembly are illustrated. These figures illustrate the operating principles for controlling the impact force upon the spray head in accordance with the present invention.

In general, as shown in all four figures, the lever arm 40 and the cam 60 are constructed and arranged such that the lever tip 44 contacts and follows the spiral surface 66 of the cam 60 during a first phase of cam rotation to move the lever arm 40 away from the container. During a second phase of cam rotation, the lever tip 44 contacts and follows the sloping surface 72 of the cam 60 to allow the lever arm 40 to move toward the container and to depress the spray head 16 in a controlled manner. Accordingly, at the precise point of cam rotation when the lever tip 44 begins its downward movement, i.e., at the drop-off edge 68, the cam must be constructed to remain in contact with the lever tip 44 and provide an upward or counteracting force to control the downward movement and dampen the impact.

For this impact force-damping operation to occur, the relative spacing between the pivot point 50 at the second end 46 of the lever arm and the central axis 62 of the cam 60 are such that, at the precise time that the lever tip 44 reaches the drop-off edge 68 of the spiral surface 66, the drop angle $\alpha$, as measured between the major longitudinal axis 94 of the lever arm 40 and the generally sloping surface 72 at the drop-off point 68, is less than 90°. In the preferred embodiment, this drop angle o is less than 83°, such that the sloping surface 72 provides sufficient resistance to control the downward movement of the lever arm 40 and dampen the slap noise. It has been found that a minimum drop angle $\alpha$ of 85° is required to begin to dampen the slap noise using the particular spring tension and motor speed of the preferred embodiment. This principle of operation can be accomplished by constructing the shape of the cam 60 in various ways, depending upon the dimensions and placement of the lever arm.

Figure 3A:
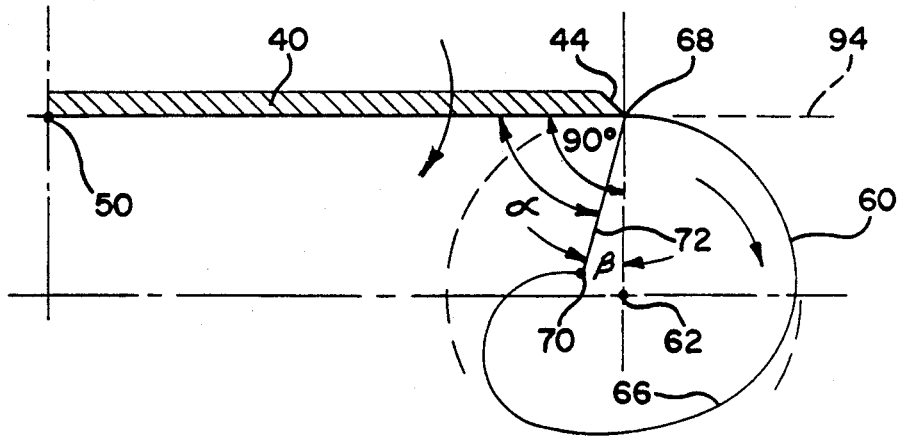
FIGS. 3A–3D are graphic representations of possible structural configurations of the cam/lever arm assembly in accordance with the present invention.

As can be seen from FIG. 3A, if the pivot point 50 of the lever arm 40 is at the same height as the cam drop-off point 68, the lever tip 44 will free-fall downwardly if there is no cam surface below the lever tip to dampen the fall. This free-fall would occur if the cam outer surface followed the vertical cam radial from the cam central axis 62 through the drop-off point 68. This free-fall would also occur in the case of a shorter lever arm, wherein the lever tip 44 reached the drop-off point 68 at an earlier point in the rotation of the cam, e.g., at 330° of clockwise cam rotation from that shown in FIG. 3A. In other words, a lever arm free-fall will typically occur if the drop angle $\alpha$ between the major longitudinal axis 94 of the lever arm 40 and the generally flat portion of the sloping surface 72 of the cam 60 is equal to or greater than 90°. This principle does not take into account the small amount of horizontal movement of the lever tip 44 as it moves along its arcuate path around the pivot point 50. However, if the lever arm 40 is relatively long with respect to the cam radius, the arcuate path can be disregarded in FIG. 3A.

The principle of maintaining the drop angle $\alpha$ less than 90° can be accomplished in numerous different ways. For example, as shown in FIG. 3A, the inner corner 70 of the spiral surface 66 has been moved outwardly, away from the cam central axis 62, such that the bottom of the sloping surface 72 at the inner corner 70 slopes toward the lever arm pivot point 50. In this embodiment, the cam slope angle $\beta$, as measured from the vertical cam radial from the cam central axis 62 through the point where the lever tip 44 exactly corresponds to the drop-off edge 68, is approximately 7°. However, it has been found that any slope angle $\beta$ within the range of 4° to 10° can provide an appropriate counteracting force, depending upon other factors mentioned below.

Figure 3B:
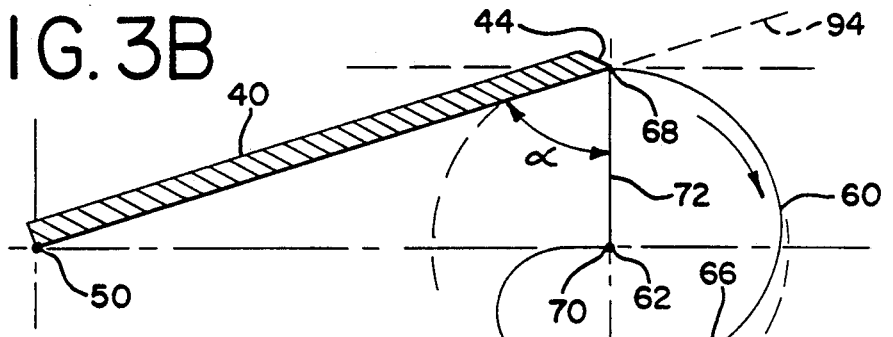

From FIG. 3B, it can be seen that the same result of providing a sloping surface to the lever tip 44 can be accomplished by lowering the pivot point 50 of the second end 46 of the lever arm 40 below the horizontal level of the drop-off edge 68 as shown. As long as the lever arm 40 is longer than the distance from the pivot point 50 to the drop-off edge 68, the lever arm 40 cannot free-fall from the drop-off point 68 because of the arcuate path the lever tip 44 follows as it drops. Hence, the cam 60 need not be constructed such that the inner corner 70 of the spiral surface 66 is moved away from the cam central axis 62 as was the case in the horizontal lever arm of FIG. 3A. In FIG. 3B, the drop angle $\alpha$ will remain less than 90° as the lever tip 44 slides down the sloping surface 72. In the preferred embodiment, this drop angle $\alpha$ is less than 83° wherein a sufficient slope is presented to the tip portion 44 such that the impact force is controlled as the cam 60 rotates clockwise.

Figure 3C:
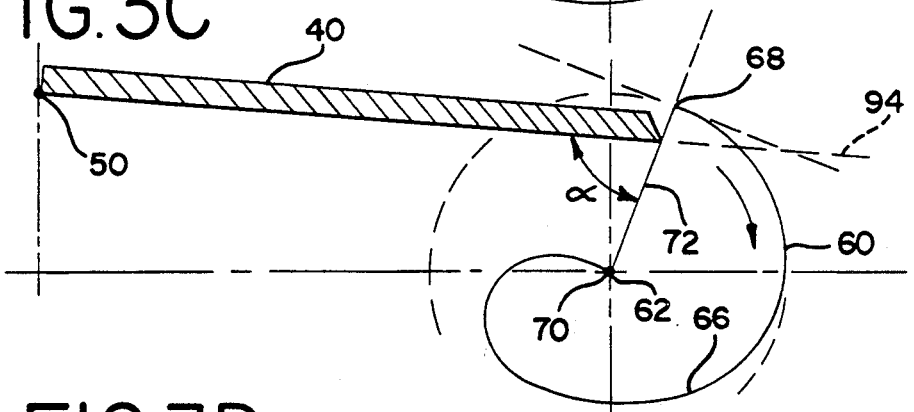

In FIG. 3C, it can be seen that the same result of providing a sloping surface 72 to the lever tip 44 can be accomplished, even in the case of the horizontally-mounted lever arm, by either reducing the relative spacing between the lever arm pivot point 50 and the central axis 62 of the cam 60, or, equivalently, by lengthening the lever arm 40 as measured by the distance between the lever tip 44 and the lever arm pivot point 50. In this way, the lever tip 44 will reach the drop-off edge 68 of the cam 60 at a point in the rotation of the cam which is past the vertical, i.e., wherein the drop angle $\alpha$ is again less than 90°. Note in FIG. 3C, like FIG. 3B, that the sloping surface 72 can be provided without relocating the inner corner 70 of the cam spiral surface 66. However, if the lever arm is too short, the lever tip 44 will immediately fall over the drop-off edge 68, and not reduce the impact and noise on the spray head. On the other hand, if the lever arm is too long, too much damping of the lever arm impact force may result.

According to the invention, the sloping surface 72 need only present a sufficient amount of frictional resistance to the lever tip portion 44 of the lever arm 40 to control its downward impact force. Accordingly, the function of the snail-shaped cam 60 of the preferred embodiment may also be accomplished using alternatively-shaped cams. For example, it is contemplated that any cam configuration having any abrupt edge for releasing a lever arm, or any other impact-type actuating mechanism, can be modified to provide the function of the sloping surface 72 of the preferred embodiment, so long as the shape serves the same purpose of controlling the downward force of the lever arm by continuing to engage the lever tip as it begins to descend.

Figure 3D:
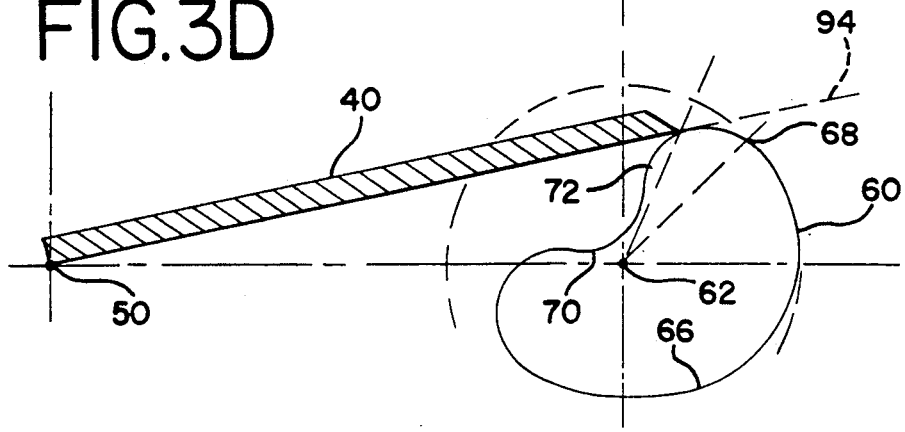

For example, FIG. 3D illustrates a kidney-shaped cam 60 as an alternative embodiment. This embodiment would still control the impact force, even though the cam has a sloping surface 72 with a slight curvature following the drop-off edge 68, as opposed to the generally-flat sloping surface following an abrupt edge. Furthermore, the sloping surface 72 may have a double curvature in the form of an "S" as shown, to provide a smooth transition at the spiral inner corner 70. Numerous other configurations may also be used, depending upon various dynamic force characteristics of the components used in the device.

As can now be seen from these figures, at least five primary factors contribute to the downward impact of the lever arm upon the spray head. First is the slope angle $\beta$ of the cam sloping surface. Second is the length of the lever arm. Third is the horizontal distance between the central axis of the cam and the pivot point of the lever arm. Fourth is the vertical distance between the cam central axis and the lever arm pivot point. Fifth is, of course, the tension of the biasing spring 54. All of these primary factors are interrelated.

Numerous other factors also contribute to the amount of downward impact force and associated impact noise. Of course, the tension of the pump spring 24 is a factor. The presence or absence of fluid in the spray pump, as well as the viscosity of the fluid, will also affect the hydraulic characteristics of the spray pump and thus contribute to the amount of impact force damping. Other factors include the overall dimensions of the device, such as the radius of the cam, the mass and hardness of the lever arm, etc. The speed of the cam rotation, which is proportional to the speed of the motor, is also a factor. However, at cam rotational speeds on the order of 1 to 5 seconds per revolution, the effect of the cam speed is minimal. Similarly, the amount of resistance the motor shaft has to being rotated by an external force, and the amount of free play in the drive gears between the motor shaft and the cam itself, also contribute, since the lever arm movement is dampened by forcing the rotation of the cam slightly faster than its rotation provided by the motor. In other words, the amount of counteracting torque the cam gear provides to the sloping surface is important, as will be seen below. Since all these factors can play some part in controlling the impact force on the spray head, the present invention provides a means for adjusting the impact force on the container. As will be seen below, the bracket 56 includes a number of notches 58 for adjusting the tension of the biasing spring 54.

Figures 4A, 4B, 4C:
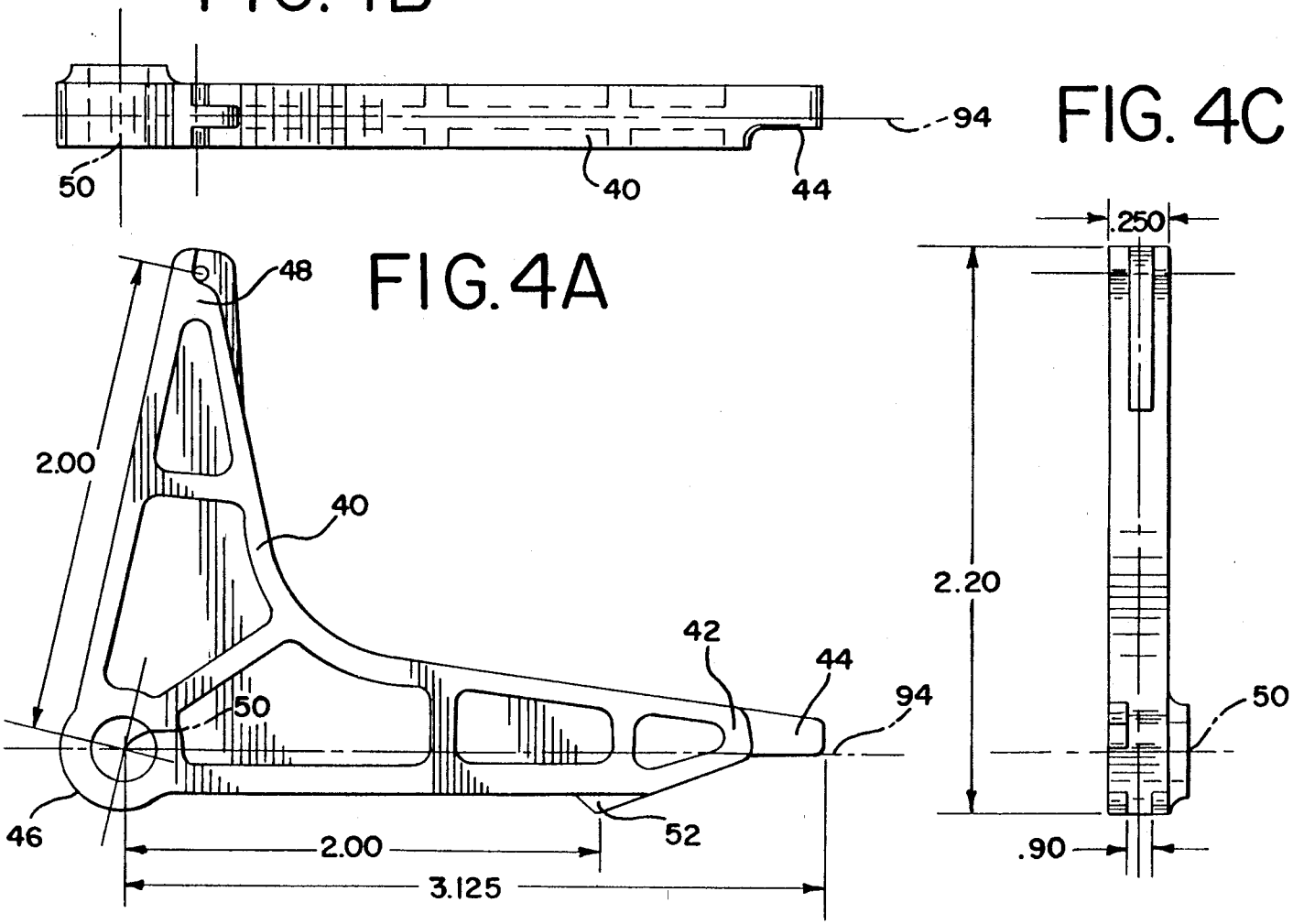
FIGS. 4A–4C provide a detailed front view, top view, and right side view, respectively, of the lever arm used in the preferred embodiment.

FIGS. 4A–4C provide a detailed front view, top view, and right side view of the lever arm used in the preferred embodiment. As shown in the figures, the lever arm 40 is configured generally in the shape of the letter "L", wherein the pivot point 50 is disposed within the second end 46 of the lever arm. However, numerous other lever arm shapes and configurations could also be used. In the preferred embodiment, the lever arm 40 is constructed of nylon, although other materials may perform better in different applications. In this embodiment, the length of the lever arm, as measured from the center of the pivot point 50 to the outermost point of the lever tip 44, is 3.125 inches (79.24 mm).

Figure 5B:
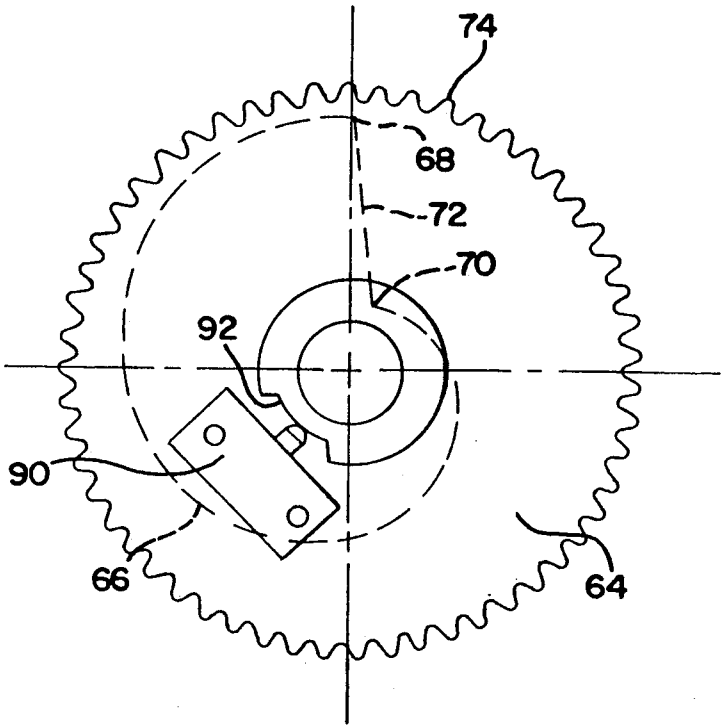
FIGS. 5A and 5B provide a detailed front and back view of the cam and cam gear used in the preferred embodiment.
Figure 5A:
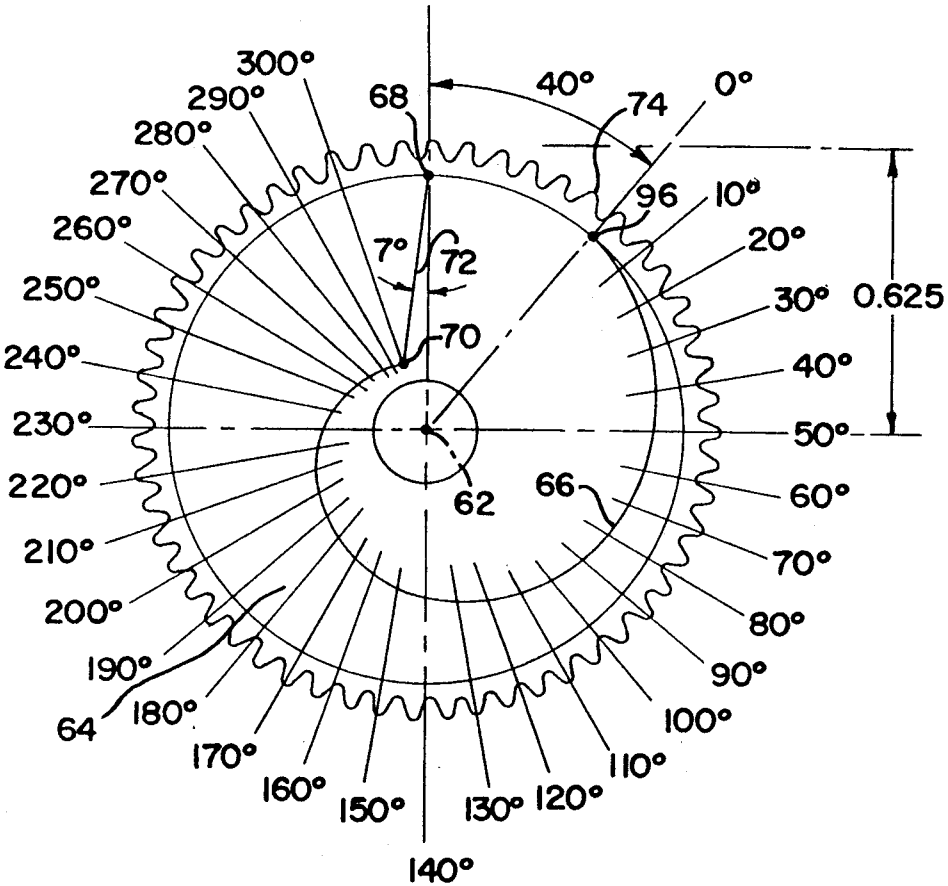

FIGS. 5A and 5B provide a detailed front and back view of the cam and cam gear used in the preferred embodiment. As can be seen from FIG. 5A, the maximum radius of the cam 60, as measured from the cam central axis 62 to the drop-off edge 68, is 0.625 inches (15.70 mm). The inner corner 70 of the spiral surface 66 is located 0.165 inches (4.06 mm) radially from the central axis 62 of the cam. From the inner corner 70, the outer surface of the cam 60 spirals outwardly with increasing radii until it reaches point 96, at approximately 40° to the right of the vertical axis, wherein the radius becomes constant. FIG. 5B represents the back side view of the cam 60 and cam gear 64, showing in more detail the position of the cycle switch 90 with respect to the cam shaft recess 92.

Figure 6C:
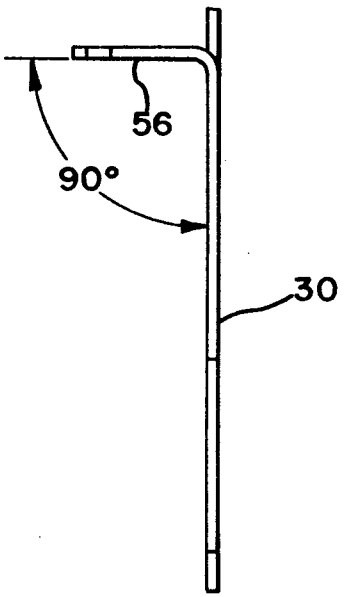
FIGS. 6A–6C provide a detailed front view, top view, and right side view, respectively, of the baseplate used in the preferred embodiment.
Figure 6B:
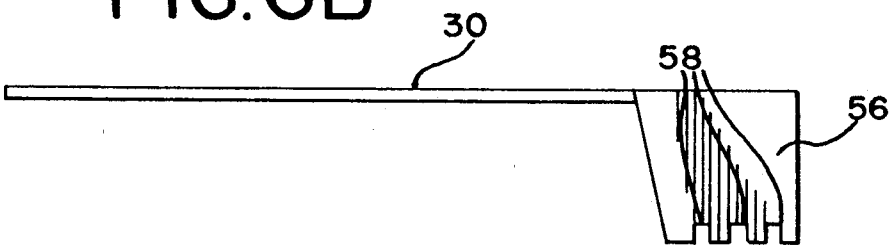
Figure 6A:
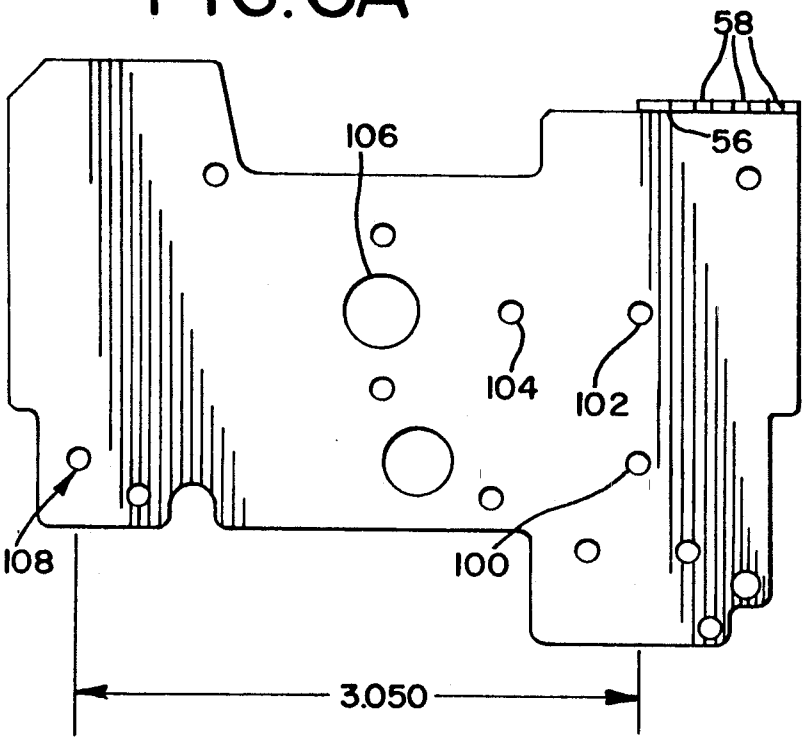

FIGS. 6A–6C provide a detailed front view, top view, and right side view, respectively, of the baseplate 30 used in the preferred embodiment. In this embodiment, the baseplate is constructed from a sheet of galvanized steel. The central axis 62 of the cam 60 is coincident with the central axis of aperture 100; the central axis of drive gear 78 is coincident with that of aperture 102; the central axis of drive pulley 82 is coincident with that of aperture 104; and the motor shaft 86 is mounted through aperture 106. A stub shaft fits into aperture 108 and provides the pivot point 50 of the lever arm 40. The distance between the pivot point 50 and the cam central axis 62 is, in the preferred embodiment, 3.050 inches (77.4 mm).

As mentioned above, the length of the lever arm 40 is one of the most important factors in compensating for the downward impact force. The proper length of the lever arm can be empirically determined during the design process by: (1) extending the length of the lever arm to be longer than the distance between the pivot point 50 and the cam central axis 62, or conversely, shortening the distance between the pivot point 50 and the cam central axis 62 to be shorter than the length of the lever arm; (2) repetitively shortening the lever tip 44 in increments of 0.010 inch (0.25 mm) while testing for an excessive impact force, by listening for a loud slap noise, during each rotation of the cam; and (3) adding back approximately 0.010 inches to the length of the lever arm that first produces a loud slap noise.

In the preferred embodiment, the impact force and noise of the impact was adequately reduced without over-damping the motion of the lever arm when approximately 0.060 inches to approximately 0.125 inches (1.52 mm to 3.04 mm) was added back to the length of the shortened lever arm at the lever tip when a cam was used having a slope angle $\beta$ of approximately 7°. Preferably, only 0.010 to 0.080 inches (0.25 to 2.04 mm) is added to the length of the lever arm. These dimensions provide a sloping surface which sufficiently dampens the downward motion of the lever arm for the preferred embodiment using the particular motor and spring described above. However, alterations to the spring tension or motor type would require adjustments to these dimensions. It is for this reason that the three-way adjustable spring tension bracket 56 is provided.

The biasing spring 54, in the preferred embodiment, is a wire spring having a diameter of approximately 0.25 inch (6.35 mm) and a compressed length of approximately 2.7 inches (69 mm). When the cam 60 is in the initial position, such that the lever arm is resting on the cam outer surface 66, the biasing spring 54 provides a downward force as measured at the lever tip, of approximately 9.0 pounds when the end of the spring 54 is located in the first one of the three notches. In the preferred embodiment, three notches 56 are provided for three-way adjustment of the biasing spring 54 in approximately one-pound increments, i.e., the first notch is 9 pounds, the second notch is 10 pounds, the third notch is 15 pounds. However, depending upon the desired application, a different number of notches or spacings between notches may be required.

Figure 7A:
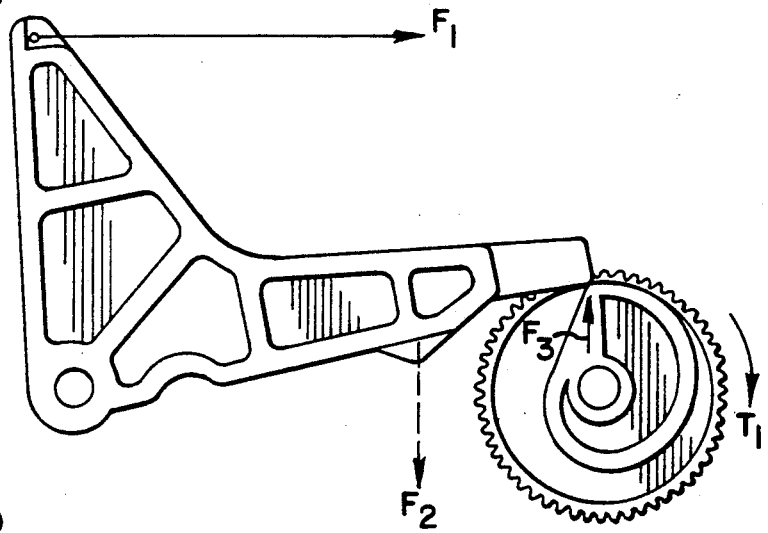
FIGS. 7A–7C are simplified front views of the cam/-lever arm assembly of the preferred embodiment illustrating the method of operation of the present invention.
Figure 7B:
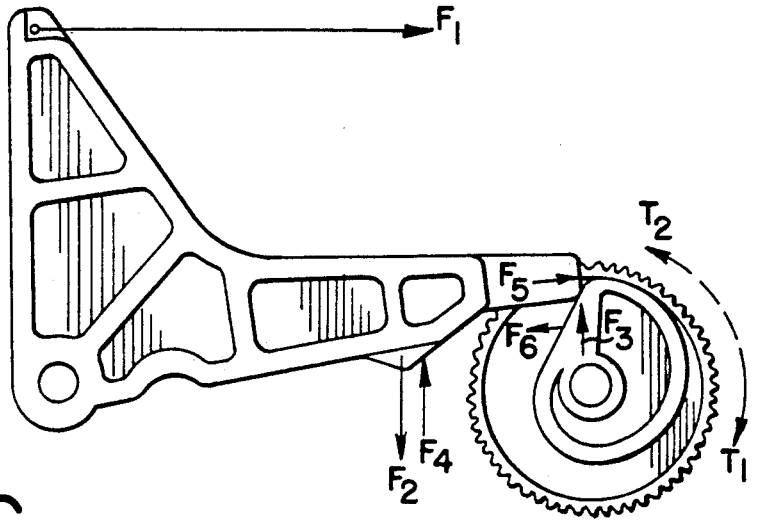
Figure 7C:
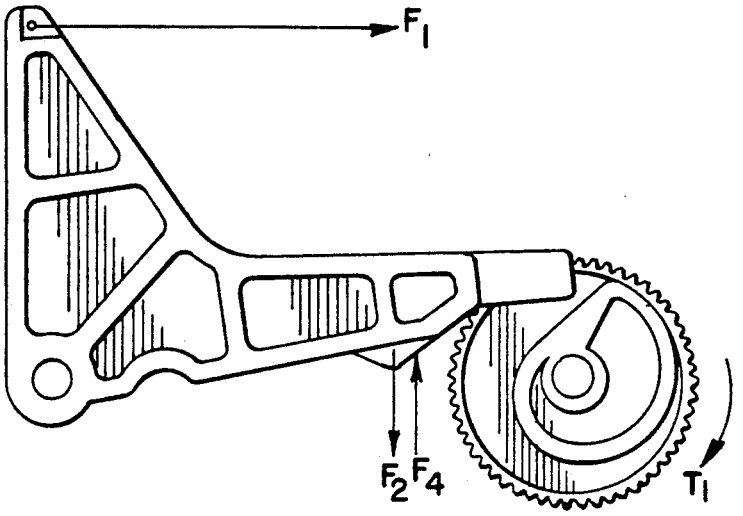

Referring now to FIGS. 7A through 7C, the method of operation of the present invention will be described in detail using the simplified front views of the cam/-lever arm assembly of the preferred embodiment.

In FIG. 7A, the cam/lever arm assembly is shown in its initial position, wherein the lever tip 44 is exactly coincident with the drop-off edge 68 of the cam 60. In this initial position, the lever tip 44 is located at its furthest point away from the central axis 62 of the cam 60. A spring force $F_1$ is supplied horizontally to the right at the third end portion 48 of the L-shaped lever arm. This horizontal spring force $F_1$ translates into a potential downward force $F_2$ at the finger 52 of the lever arm 40, as illustrated. At this point of the cam rotation, the finger 52 is at its furthest point away from the spray head 16. In this position, the downward force applied at the cam 60 by the lever arm 40 is approximately 9 pounds. To keep the lever arm stationary, the cam 60 provides an upward force $F_3$ of approximately 9 pounds to counteract the downward force on the lever arm 40.

In FIG. 7B, the cam 60 is shown rotated clockwise a few degrees, such that the lever tip 44 has passed the drop-off edge of the cam and begins to slide down the sloping surface. Again, the biasing spring force $F_1$ generates a downward force $F_2$ at the finger of the lever arm. Now, however, the downward force $F_2$ is countered by an upward force $F_3$ provided by the sloping surface of the cam. Furthermore, as soon as the lever tip passes over the drop-off edge of the cam, the lever tip applies a horizontal force $F_5$ to the cam along the longitudinal axis of the lever arm as shown. The amount of force $F_5$ is dependent upon the force $F_1$ of the biasing spring on the lever arm, which is the main source of this external force on the cam.

The motor and drive gears normally provide an internal rotational force or torque $T_1$ for rotating the cam gear in a clockwise direction as shown. The motor and drive gears further provide a counteracting rotational force or reverse torque $T_2$ to any external force which would provide additional rotation to the cam gear in the clockwise direction, i.e., the motor and cam gears resist any external forces applied to turn the cam faster than it is being turned by the motor. This reverse torque $T_2$ provides a counteracting horizontal force $F_6$ which serves to counteract the horizontal force $F_5$ of the lever arm on the sloping surface. In other words, the sloping surface applies a counteracting horizontal force $F_6$ due to the motor and gear assembly's opposition to external force $F_5$ applied in the direction of rotation. If no counteracting force were present, i.e., if the motor and/or drive gears were allowed to spin freely in a clockwise direction when external forces were applied, then the sloping surface would not dampen the downward impact of the lever arm on the container spray head.

When the cam rotates further and the lever arm slides further down the sloping surface, the finger of the lever arm contacts the spray head of the container. At this point, as shown in FIG. 7B, an upward force $F_4$ is provided by the spray pump. At this point, the downward force $F_2$ is reduced to approximately 8 pounds because the biasing spring is slightly shorter and therefore weaker. Since the pump spring is fully extended and the hydraulic forces of the pump are minimal at this time, the upward force $F_4$ provided by the spray head is approximately 5 pounds. Note that this three-pound force differential, i.e., $F_2-F_4$, produces the high impact force and associated slap noise discussed above.

As the lever tip continues to slide down the sloping surface, the biasing spring becomes shorter, and thus weaker, while the pump spring becomes shorter and stronger. This transfer of forces aids in the deceleration of the lever arm. Moreover, the upward force $F_4$ provided by the spray pump further increases due to the hydraulic forces as the fluid is being sprayed.

Eventually, as shown in FIG. 7C, the downward acceleration of the lever arm will be overcome by the increased resistive upward force $F_4$ provided by the spray pump. At this time, the pump spring and hydraulic forces will have increased such that the upward force $F_4$ is approximately 6 pounds, while the downward lever arm force $F_2$ has decreased to approximately 7 pounds. Now the difference in forces, $F_2-F_4$, is approximately 1 pound. Note that at least a one-pound downward force differential is required to maintain the pumping action.

However, the speed of the lever arm downward movement has been greatly reduced by this increased counteracting force $F_4$. At this instant of time, which occurs after at least ¼ inch of downward movement of the lever tip, the lever tip disengages from the sloping surface of the cam, and the cam continues to rotate at a constant speed such that the cam now separates from the lever tip, and thus, the lever tip no longer rides down the sloping surface. Therefore, a gap exists between the lever tip and the sloping surface. This separation is a desirable feature, since a proper balance must be maintained between the downward speed of the lever arm before it hits the spray head, and the downward force necessary to properly activate the pump spray container. Once the lever tip is disengaged from the cam, the spring force $F_1$ continues to depress the spray head downward, until the spray head either bottoms out internally within the spray pump, or physically touches the container cap. The lever arm remains in this lowermost position until the cam rotates further and begins to lift the lever tip as it contacts the spiral surface of the cam. Cam rotation continues until the cycle switch interrupts the current to the motor, wherein the cam stops in its reference position once again.

Note that if the fluid container is empty, there is less resistance due to the lack of hydraulic forces in the spray pump. Hence, the lever arm may slide completely down the sloping surface without separating from the cam. Furthermore, when the container is empty, the amount and type of slap noise on the container will differ from the noise produced when the container is full. This different sound produced when the container is empty may be used as an indicator to the user that the container needs to be refilled or replaced.

In the preferred embodiment of fragrance dispenser, the viscosity of the fragrance liquid is approximately the same as water. However, if different viscosities were used, such as alcohol, different adjustments of the biasing spring and or different cam/lever arm configurations may be required to provide a proper mist.

In review, it can now be seen that the present invention provides a fluid dispenser having an improved actuating mechanism for operating a pump-type spray container with reduced noise and improved reliability. The actuating mechanism includes an improved cam/-lever arm assembly having a lever tip which slides down the sloping surface of the cam such that it controls the downward impact force of the lever arm on the container spray head.

While specific embodiments of the present invention have been shown and described herein, further modifications and improvements may be made by those skilled in the art. In particular, it should be noted that the shape of the cam and lever arm of the preferred embodiment was chosen only as a representative shape adapted for a specific pump-type spray dispensing device. Moreover, numerous modifications can be made to suit other fluid-dispensing applications. All such modifications which retain the basic underlying principles disclosed and claimed herein are within the scope of this invention.

What is claimed is:

1. A fluid dispenser comprising:

container means for containing a fluid to be dispensed, said container means including a pump having a depressible head associated with said pump for dispensing said fluid form said container when said head is depressed with sufficient force;

housing means for supporting said container means;

cam means, rotatably affixed to said housing means, for rotating around a central axis, said cam means including an outer surface having a first surface portion constructed such that the radius of said cam means outer surface generally increases as said cam means is rotated about said central axis in a first direction, said cam means outer surface further having a second surface portion constructed such that the radius of said cam means outer surface generally decreases as said cam means is rotated about said central axis in said first direction;

means for rotating said cam means;

actuator means for depressing said depressible head upon contact with said depressible head, said actuator means having a first portion disposed adjacent said cam means, and a second portion movably connected to said housing means such that said first portion contacts and slides upon said cam means outer surface; and spring means for providing a force on said actuator means such that said first portion of said actuator means is biased to maintain contact with said cam means outer surface during at least a part of the rotation of said cam means, and such that said actuator means provides a spring force to said depressible head, said cam means outer surface controlling said spring force on said depressible head during the partial rotation of said cam means when said actuator means remains in contact with said second surface portion of said cam means outer surface and said actuator means depresses said depressible head with a controlled amount of force.

2. The fluid dispenser according to claim 1, wherein said depressible head includes orifice means for spraying said fluid from said container when said head is depressed with sufficient force.

3. The fluid dispenser according to claim 1, wherein said cam means first surface portion is formed generally in the shape of a spiral having an inner endpoint and an outer endpoint such that the radius of said first surface portion increases as said cam means is rotated about said central axis in a first direction, and wherein said cam means second surface portion is formed as a generally flat surface and connecting said spiral inner and outer endpoints.

4. The fluid dispenser according to claim 3, wherein said cam means in constructed such that said spiral inner endpoint is not coincident with a radial directed from said cam central axis to said spiral outer endpoint, and wherein the angle between said generally flat surface and sad cam radial is between 4° and 10°, said flat surface and said spiral inner endpoint forming an obtuse angle where said flat surface is connected to said spiral inner endpoint.

5. A fluid spray dispenser comprising:

container means for containing a fluid to be sprayed, said container means including a spray pump having a depressible spray head disposed outside said container means, and having orifice means for spraying said fluid when said spray head is depressed with sufficient force;

housing means for supporting said container means;

a cam rotatably affixed to said housing means and rotatable around a central axis, said cam having an outer surface having a first portion formed generally in the shape of a spiral having an inner endpoint and an outer endpoint such that the radius of said cam outer surface increases as said cam is rotted about said central axis in a first direction, said cam outer surface further having a second portion formed as a generally flat surface and connecting said spiral inner and outer endpoints;

means for periodically rotating said cam in said first direction at a constant rate of rotation;

a lever arm having first and second end portions and a major longitudinal axis located between aid first and second end portions, said first end portion having an outermost lever tip, said second end portion pivotally affixed to said housing mean s such that said lever tip is adapted to contact said cam outer surface, and such that a portion of said lever arm is adapted to engage with and depress said spray head; and spring means for providing a force on said lever arm such that said lever tip is biased toward said spray head, said lever arm, cam, and spring means operatively connected such that said lever tip of said lever arm contacts and follows said first portion of said cam outer surface during a first part of said cam rotation to move said lever arm away from said container means, and such that said lever tip contacts and follows said second portion of said cam outer surface during a second part of said cam rotation to allow said lever arm to move toward said container means and depress said spray head with a controlled force, wherein said lever tip slides along at least a portion of said generally flat surface in a controlled manner so as to reduce the impact of said lever arm on said spray head.

6. The fluid spray dispenser according to claim 5, wherein said housing means is constructed such that the relative spacing between said pivotally-affixed second end portion of said lever arm and said cam central axis are such that, when said lever tip reaches said spiral outer endpoint during cam rotation, the angle between said major longitudinal axis of said lever arm and said generally flat surface of said second portion of said cam outer surface is less than 90°.

7. The fluid spray dispenser according to claim 6, wherein said angle is equal to or less than 83°.

8. The fluid spray dispenser according to claim 5, wherein said cam is constructed such that said spiral inner endpoint is not coincident with a radial directed from said cam central axis to said spiral outer endpoint, and wherein the angle between said generally flat surface and said cam radial is between 4° and 10°.

9. The fluid spray dispenser according to claim 5, wherein said spray pump is a hydraulic-type fluid pump having a return spring which requires between 3 and 8 pounds of force to depress said spray head in order to produce a proper spray from said container means.

10. The fluid spray dispenser according to claim 5, wherein said spring means provides a force on said lever arm such that said lever arm would provide a force of greater than 8 pounds upon initial impact upon said spray head if said lever tip did not contact and follow said second portion of said cam outer surface during said second part of said cam rotation and said lever arm was allowed to move toward said container means and depress said spray head in an uncontrolled manner.

11. The fluid spray dispenser according to claim 5, wherein said lever arm, cam, and spring means are operatively connected such that said lever tip separates from said cam generally flat surface before said lever tip reaches said spiral inner endpoint.

12. The fluid spray dispenser according to claim 5, wherein said cam is constructed such that said lever tip slides along said generally flat surface for a distance of at least ¼ inch.

13. The fluid spray dispenser according to claim 5, wherein said lever arm is generally L-shaped.

14. The fluid spray dispenser according to claim 5, wherein said housing means includes means for adjusting the tension of said spring means.

15. The fluid spray dispenser according to claim 5, wherein said means for periodically rotating said cam includes an electric motor and an electronic timing circuit.

16. An actuation mechanism for a pump-type spray container having a spray head constructed and arranged to spray a fluid form said container when said spray head is depressed toward said container, said actuation mechanism comprising:

a base;

an electric motor mounted to said base;

an electric power source;

electronic circuitry for applying and controlling the electric power from said electric power source to said electric motor;

a cam assembly having a cam and plurality of drive gears engaging said motor and said cam for providing an internal force for rotating said cam in a first direction, said motor and cam assembly operatively connected to provide a counteracting force to any external force providing additional rotation to said cam in said first direction;

a lever arm having a major longitudinal axis and a first portion pivotally mounted to said base, and a movable end having a tip portion constructed and arranged to cooperate with said cam to move said lever arm as said cam rotates, and an actuator portion constructed and arranged to depress said spray head of said pump-type spray container; and a spring coupled between said lever arm and said base for providing a spring force to said lever arm for depressing said spray head;

said lever arm contacting said cam such that said lever arm moves with the rotation of said cam by forcing said lever tip portion away from said spray head during a first phase of cam rotation, and by substantially but not entirely releasing said lever tip portion during a second phase of cam rotation such that said spring force causes said lever arm to quickly depress said spray head;

said cam preventing said lever tip portion from being entirely released from said cam during said second phase of cam rotation such that said spring force on said lever arm provides said external force on said cam, and such that said motor and cam assembly provide said counteracting force to provide a slight damping action to said lever arm movement during at least a portion of said second phase of cam rotation.

17. The actuation mechanism according to claim 16, wherein said cam is formed generally in the shape of a spiral having an inner endpoint and an outer endpoint such that the radius of said cam increases as said cam is rotated in a first direction, and having a generally flat surface connecting said spiral inner and outer endpoints.

18. The actuation mechanism according to claim 17, wherein said cam is constructed such that said spiral inner endpoint is not coincident with a radial directed from the cam central axis to said spiral outer endpoint, and wherein the angle between said generally flat surface and said cam radial is greater than 3°.

19. A method of operation of a pump-type fluid spray dispenser having a pump actuation mechanism wherein the noise and impact force of said actuation mechanism is controlled, said pump-type fluid spray dispenser including a cam and lever assembly constructed and arranged to provide an inward force on a container spray head for a first period of time, and to release the inward force on said container spray head for a second period of time by forcing said lever away from said spray head by cooperating with said cam, said cam having an outer surface with a maximum radius point between an increasing diameter surface portion and a decreasing diameter surface portion, said method comprising the steps of:

(a) turning said cam in a first direction and forcing said lever away from said spray head using said cam;

(b) further turning said cam in said first direction until said lever passes maximum radius point of said cam outer surface; and (c) controlling the impact of said lever on said container spray head by maintaining said lever in sliding contact with said decreasing diameter surface portion of said cam for a predetermined time period after said lever arm passes over said maximum radius point.

20. The method according to claim 19, further comprising the step of:

(d) further turning said cam in said first direction and separating said lever from said cam after said lever has contact said spray head.

* * * * *